United States Patent [19]

Odier

[11] 3,981,505

[45] Sept. 21, 1976

[54] PUZZLE WITH IRREGULAR PENTAGONAL PIECES

[76] Inventor: Marc G. Odier, 85 Blvd. Exelmans, Paris 16, France

[22] Filed: Mar. 1, 1973

[21] Appl. No.: 337,117

[52] U.S. Cl, ..... 273/157 R; 273/137 D

[51] Int. Cl.[2] ..... A63F 9/10; A63F 9/20

[58] Field of Search ..... 273/137 AE, 137 D, 137 R, 273/153 R, 156, 157; 46/17

[56] References Cited

UNITED STATES PATENTS

| | | | |
|---|---|---|---|
| 3,280,499 | 10/1966 | Studen | 46/17 |
| 3,608,906 | 9/1971 | Odier | 273/157 R |
| 3,638,947 | 2/1972 | Hardesty | 273/137 D |

FOREIGN PATENTS OR APPLICATIONS

| | | | |
|---|---|---|---|
| 1,219,551 | 1/1971 | United Kingdom | 273/137 D |

OTHER PUBLICATIONS

P. A. Macmahon; *New Mathematical Pastimes;* Cambridge Univ. Press 1921; pp. 1, 100–106.

*Primary Examiner*—Anton O. Oechsle

*Attorney, Agent, or Firm*—Wolf, Greenfield & Sacks

[57] ABSTRACT

A puzzle is provided having a plurality of puzzle pieces, each piece being of identical shape defined by a planar irregular pentagon. The shape of the irregular pentagon and the angles defined at the apices are arranged so that the puzzle pieces may be placed on a planar supporting surface in side to side abuttment to cover fully the surface and in a variety of configurations and juxtapositions. Each apex in each of the puzzle pieces is provided with indicia of a value selected from M possible values. According to the preferred rules of the puzzle, the pieces are to be placed on the support in such a manner that each apex in a given group of adjacent apices carries the same indicia of value as the other apices in that group. The number of puzzle pieces is limited so that no two puzzle pieces have the same configurations of indicia of value. In one embodiment the puzzle includes thirty-two pieces and in a second embodiment, twenty pieces.

2 Claims, 6 Drawing Figures

FIG. 1
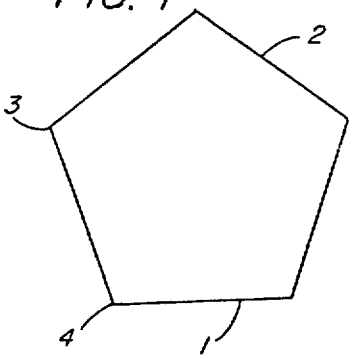
FIG. 2
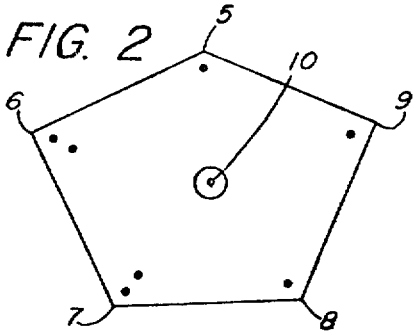
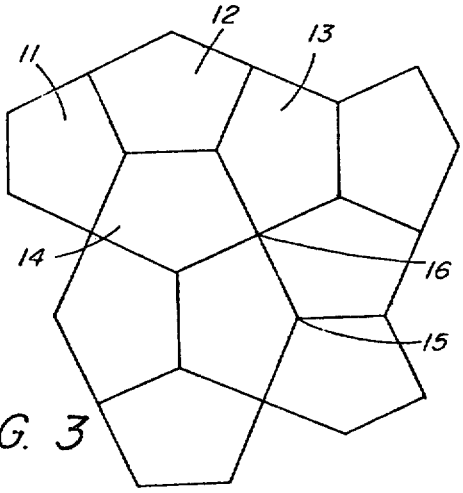
FIG. 3
FIG. 4
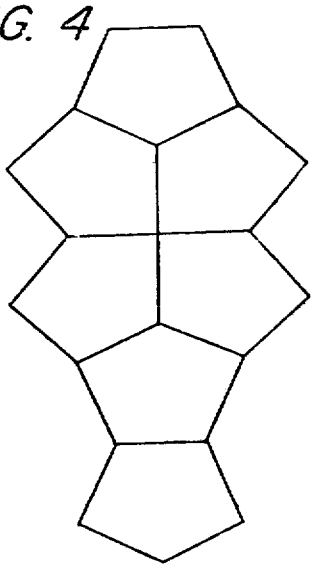
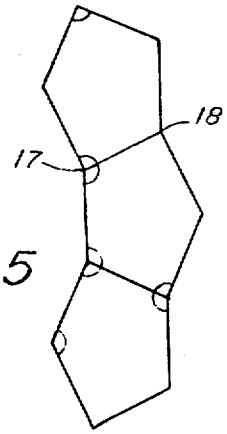
FIG. 5
FIG. 6
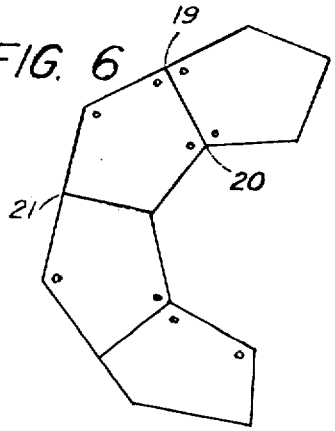

PUZZLE WITH IRREGULAR PENTAGONAL PIECES

BACKGROUND OF THE INVENTION

My invention is an improvement over the puzzles shown in my prior patents, U.S. Pat. No. 3,608,906 dated Sept. 28, 1971, U.S. Pat. No. 3,687,455 and my French Pat. No. 1,582,023. These puzzles, as well as other related types of puzzles having domino-like rules of assembly typically are characterized by regular polyhedral shaped pieces which result in the puzzle having either many pieces and being very complex or relatively few pieces and being very easy to solve. It is among the objects of the invention to provide a puzzle of the general type described which has a moderate number of pieces and which is of medium complexity.

SUMMARY OF THE INVENTION

In each embodiment of the invention each of the puzzle pieces is of irregular pentagonal shape in which each side of the pentagon is of substantially equal length and in which two of the apices define a first predetermined angle, two other apices define a second predetermined angle larger than the first and the remaining apex defines an angle greater than the other first or second predetermined angles. Each of the apices of each piece is provided with an indicia value selected from M possible values where M is at least and is preferably two. While each piece in the puzzle is of identical shape and size, no two pieces embody the same arrangement of indicia at its apices.

It is among the objects of the invention to provide a puzzle of the general type described which is of moderate complexity.

A further object of the invention is to provide a puzzle of the type described in which each of the pieces is of irregular pentagonal configuration.

DESCRIPTION OF THE DRAWINGS

The foregoing and other objects and features of the invention will be appreciated more fully from the following detailed description thereof, with reference to the accompanying drawings wherein:

FIG. 1 is an illustration of a regular pentagon in which the angle defined at each apex is the same (108°);

FIG. 2 is an illustration of the shape of an irregular pentagonal piece of the puzzle;

FIG. 3 is an illustration of a plurality of puzzle pieces arranged in abutment with each other to define a continuous planar region and illustrating the manner in which the assembly of a number of puzzle pieces define groups of adjacent apices;

FIGS. 4, 5 and 6 show, somewhat schematically, three other types of configurations of groups of puzzle pieces.

DESCRIPTION OF THE PREFERRED EMBODIMENTS

For ease of explanation in the following description of the invention, the arrangement of the indicia of value at each of the apices of any given puzzle piece will be represented by the sequence of the five indicia at the five apices starting with the widest angle or main apex, such as that indicated in 5 in FIG. 2 and reading the other values sequentially in a clockwise direction. Thus, the piece shown in FIG. 2 would be designated (11122). It may be noted that in the preferred embodiment of the invention, such as suggested in FIG. 2, there are two different indicia of value (M = 2). While in FIG. 2 this has been shown as represented by either one or two dots, any similar type of arrangement may be employed. Thus, as suggested in FIG. 6 the indicia may take the form of one dot or no dots. As suggested in FIG. 5 the indicia may take the form of a marking representing an arc segment of a circle or the absence of such marking.

In one embodiment of the invention there are thirty-two identically shaped puzzle pieces as shown in FIG. 2, each bearing different indicia markings from the other and including all possible combinations of the indicia when M = 2. In this embodiment where there are two possible indicia of value the thirty-two puzzle pieces may be separated into sixteen subgroups of two pieces each. The following table illustrates the arrangement of the indicia of each of the pieces:

TABLE I

| (1) | (2) | (3) | (4) | (5) | (6) | (7) | (8) |
|---|---|---|---|---|---|---|---|
| 00000 | 00001 | 00010 | 00011 | 00100 | 00101 | 00110 | 00111 |
| 11111 | 11110 | 11101 | 11100 | 11011 | 11010 | 11001 | 11000 |
| (9) | (10) | (11) | (12) | (13) | (14) | (15) | (16) |
| 01000 | 01001 | 01010 | 01011 | 01100 | 01101 | 01110 | 01111 |
| 10111 | 10110 | 10101 | 10100 | 10011 | 10010 | 10001 | 10000 |

It may be noted from the foregoing table that in each subgroup the pair of puzzle pieces bear indicia of value which are complementary to each other. No two puzzle pieces bear the same sequential configuration of indicia. One of the pieces may have no visible markings on either side (the piece 00000). This piece may appear the same as the backside of one of the other pieces. It may be desirable to provide the "blank" piece (00000) with some other identifying means such as a marking suggested at 10 in FIG. 2.

Each of the puzzle pieces is of an irregular pentagonal shape, with each side being substantially equal in length. Each piece is characterized by apices having two non-consecutive right angles (apices 6 and 9 in FIG. 2) an apex defining an obtuse angle between the two right angled apices of the order of 131° 24′ (apex 5 in FIG. 2) and two consecutive equal obtuse angles having an angle of approximately 114″ 18′ (indicated at 7 and 8 in FIG. 2).

It may be noted here that a puzzle piece of regulaar pentagonal shape, with the angle at each apex being the same, would not give the same or satisfactory results. One of the reasons is that regular pentagonal shapes cannot be arranged in continuous butting relation to define a substantially continuous planar cover. In addition, because of the symmetry of the regular pentagonal shape, if two indicia of value (M = 2) were employed, there would be only eight different possible indicia combinations. As indicated above, a puzzle having only eight such pieces would be very easy to solve and would stimulate little interest. In contrast, my invention which employs both the irregular pentagonal shape for the pieces as well as preferably two indicia of value enables a puzzle to be made which is of moderate complexity and yet which is not exceedingly complex.

FIG. 3 illustrates one of the possible arrangements, apart from apex value considerations, of the puzzle pieces. Four of the irregular pentagonal pieces, 11, 12, 13 and 14 can be arranged to form an irregular hexagon having four long sides and two short sides. Several such irregular hexagons can be made and the irregular hexagons can, in turn, be arranged adjacent each other to form the continuous planar covering. FIG. 3 also illustrates the manner in which the apices of the assembled pieces form groups of three apices each, as indicated at 15 in FIG. 3 or groups of four apices as indicated in 16 in FIG. 3. It should be appreciated that by placing suitable indicia of value at the apices of the puzzle pieces, the manner in which the pieces may be assembled becomes limited and makes solution of the puzzle an interesting mental task.

FIG. 4 shows still another manner in which the irregular pentagonal puzzle pieces may be arranged without forming a continuous covering but forming a "line" with the same pieces, still respecting the conditions of the arrangement of at least two apices for each piece.

FIG. 5 shows a further method of assembly of the pieces in which the rules of assembly may require that one of the right angles and one of the two equal obtuse angles lie adjacent corresponding portions of the adjacent puzzle piece. In this illustration, the indicia are in the form of circular segments and the absence of the circular segments. Thus, at 17 each of the two adjacent apices bear a segment of a circle and at 18 the adjacent apices are free of the circular segments, etc.

The puzzle pieces can be fabricated from any of a variety of materials such as cardboard, metal, wood, plastic or the like. The game pieces may be packaged in a box which includes holders for each of the pieces to enable the user to arrange the pieces in their various subgroups and classifications. The puzzle set may also include a flat magnetic sheet with the puzzle pieces being made from a ferrous material so that the puzzle pieces can be securely placed on the magnetic plane. In still another variation, the puzzle pieces can be made from a buoyant material so that they may be used at the seashore, in a swimming pool or the like.

The invention has been described thus far in relation to a set of puzzle pieces embodying thirty-two pieces, each having a different combination of indicia on its five apices. In that embodiment, only one side of each of the puzzle pieces is marked with such indicia, the other side having no indicia markings at all. In a modification of the invention, an identical array of indicia is formed on the reverse side of each of the pieces. For example, in the puzzle piece illustrated in FIG. 2 the apices 5, 8, and 9 will each have one dot on each side of the puzzle piece, the apices 6 and 7 will each have two dots on each side of the piece, etc. When each of the pieces is turned over, they present a mirror image of the array of indicia on the other side. For example, the puzzle piece shown in FIG. 2 may be identifiable as (11122), but when turned over, its mirror image of the array of indicia would be identifiable as (12211). Thus, it will be seen that where each piece includes the corresponding indicia on its reverse side, less than thirty-two pieces will be needed in order to account for all thirty-two possible indicia configurations. The mirror image of any given piece may be the same as the combination of indicia on any unturned piece. With this arrangement only twenty puzzle pieces are required for a full set which includes all of the various possible indicia configurations. This can be seen further from table 1. The mirror image of the piece in subgroup 2 (00001) is (01000). This mirror image is identical to the piece in subgroup No. 9. Thus, the pieces of subgroup No. 2 can play a dual role of the pieces in subgroup No. 9 and the subgroup No. 9 pieces can be eliminated. A study of the table shows that subgroups 5, 8, 9, 11, 12 and 13 all have mirror image equivalents and can be eliminated in the twenty puzzle piece embodiment. It may be noted that where the indicia are to be on both sides of the pieces, the indicia may take the form of holes (or their absence) punched or otherwise formed through the pieces at their apices.

The rules of assembly may be varied in any number of ways. For example, they may require that the assembly of the puzzle pieces also form a specific shape which may be symmetrical or not. An extra piece of the same shape as the other puzzle pieces may be provided in which the extra piece has at least one apex bearing a variable indicia of value so that that piece may serve as a "joker".

It should be understood that the foregoing description of the invention is intended merely to be illustrative thereof and that other modifications and embodiments may be apparent to those skilled in the art without departing from its spirit.

In FIG. 6 the puzzle pieces are arranged in a circle. For this configuration the angle value for all the pieces can be modified slightly permitting a more perfect circle and acceptable other configurations as shown in FIGS. 3 and 4.

Having thus described the invention what I desire to claim and secure by Letters Patent is:

1. A puzzle comprising:

a plurality of substantially identically shaped planar puzzle pieces, each being in the form of an irregular pentagon having sides of substantially equal length and having apices defining consecutive angles of approximately 131°, 90°, 114°, 114° and 90°;

means forming indicia of value at each apex of at least one side of each puzzle piece, said indicia of value being selected from M possible values and where M is at least equal to two;

said indicia being formed on each side of each of said puzzle pieces with each side of each apex having identical indicia whereby turning over of each piece presents a mirror image of the configuration of indicia presented by that piece before turning over, said puzzle including twenty puzzle pieces, the total number of indicia configurations being thirty-two.

2. A puzzle as defined in claim 1 wherein said indicia are formed by means defining holes through said pieces selectively in the regions of said apices.

* * * * *